United States Patent [19]

Okazaki

[11] Patent Number: 4,726,505

[45] Date of Patent: Feb. 23, 1988

[54] ELECTRIC STAPLER

[75] Inventor: Kunihachi Okazaki, Chiba, Japan

[73] Assignee: Maruzen Kabushiki Kaisha, Tokyo, Japan

[21] Appl. No.: 2,670

[22] Filed: Jan. 12, 1987

[30] Foreign Application Priority Data

Apr. 8, 1986 [JP] Japan ..... 61-80850

[51] Int. Cl.[4] ..... B27F 7/19; B27F 7/36

[52] U.S. Cl. ..... 227/132; 227/120; 227/155; 227/131; 227/127

[58] Field of Search ..... 227/120, 127, 131, 132, 227/155

[56] References Cited

U.S. PATENT DOCUMENTS

| | | | |
|---|---|---|---|
| 2,910,700 | 11/1959 | DePaolo | 227/132 X |
| 3,305,156 | 2/1967 | Khan | 227/132 |
| 3,423,002 | 1/1969 | Hatazaki et al. | 227/131 |
| 4,186,863 | 2/1980 | Yunoki | 227/131 |
| 4,491,260 | 1/1985 | Jimena | 227/131 X |

FOREIGN PATENT DOCUMENTS

| | | | |
|---|---|---|---|
| 3426072 | 1/1986 | Fed. Rep. of Germany | 227/131 |

*Primary Examiner*—Paul A. Bell

*Attorney, Agent, or Firm*—James E. Nilles

[57] ABSTRACT

An electric stapler wherein a guide cylinder is fixedly disposed on a base having a groove for bending a driven staple in such a way as to form a slit for inserting papers to be stapled, and in the guide cylinder is disposed a vertically movable block having at its lower end a downwardly projecting blade for driving the staple toward the staple bending groove. The block is always given a downward pull by springs. A working arm is swingably supported by a shaft fixedly disposed at a position spaced-apart from the guide cylinder, the arm being pivotally secured at one end to an upper part of the vertically movable block and having at its other end a pressure receiving portion. There is provided a damper whereby in the state before the staple driving operation, the pressure receiving portion is pressed down against the force of the springs to retain the staple driven blade of the block at its raised-up position, and when a staple is pushed out, the pressing hold on the blade at its raised-up position is released. The operation of the damper is controlled by a motor powered by a battery.

5 Claims, 9 Drawing Figures

F I G. I

ELECTRIC STAPLER

BACKGROUND OF THE INVENTION

1. Field of the Invention

This invention relates to an electric stapler for binding chiefly sheets of paper placed one upon another by driving staples therethrough.

2. Description of the Prior Art

In the art of this type of electric stapler is known, for instance, the mechanism disclosed in Japanese Patent Laid-Open No. 137570/83. The electric stapler disclosed in this patent is essentially as outlined below. A magazine containing a strip of staples is provided movably up and down relative to the anvil and a slider arranged to push said strip of staples is elastically held by said magazine so as to be movable forwardly and backwardly. Above said magazine is swingably provided a working arm having a blade for driving the staples in said magazine one by one. The proximal end of said arm is elastically held by a compression spring which can expand and contract in the vertical direction. Substantially L-shaped drive arms are pivotally provided on both sides of said working arm, each of said drive arms being so arranged that the end of its horizontal portion is engaged with a roller disposed close to the fore end of said working arm. At the lower end of the vertical portion of each of said drive arms is rotatably mounted an eccentric roller secured to the corresponding one of a pair of pivotally supported crank discs which are operatively connected through gearing to a motor connected to a commercial power source by a cord.

The electric stapler of said mechanism is suited for binding pamphlets, booklets, etc., having a thickness in a certain range, but it has many problems in practical use. For instance, the mechanism for vertically moving the blade for driving the staples from the staple magazine is complicated and also necessitates many parts, which necessarily leads to a high manufacturing cost. Further, since the staple driver blade is moved up and down by the circular movements of the working arm and the drive arms on both sides thereof, the up and down movement of said blade in a vertical state may not be made smoothly, and a special mechanism is required for effecting such up and down movement of said blade in a vertical state. Moreover, since a commercial power source is required for the motor, the stapler is unusable where no commercial power source is available, and further handling of the cord makes trouble.

SUMMARY OF THE INVENTION

An object of the present invention is to provide a small-sized portable electric stapler which enables the accurate up and down movement of the staple driver blade in a vertical state with a simple mechanism, and which can be used even in a place where no commercial power source is available and also makes it unnecessitated to use a cord.

According to the electric stapler of this invention, a guide cylinder is fixedly disposed on a base having a groove for bending the driving staple in such a way as to form a slit for inserting papers to be stapled, and in said guide cylinder is disposed a vertically movable block having at its lower end a downwardly projecting blade for driving the staple toward said staple bending groove. Said block is always given a downward pull by springs. A working arm is swingably supported by a shaft fixedly disposed at a position spaced-apart from said guide cylinder, said arm being pivotally secured at one end to an upper part of said vertically movable block and having at its other end a pressure receiving portion. There is provided a damper whereby in the state before the staple driving operation, said pressure receiving portion is pressed down against the force of said springs to retain the staple push-out blade of said block at its raised-up position, and when a staple is driven, the pressing hold on said blade at its raised-up position is released. The operation of said damper is controlled by a motor powered by a battery.

In use of the electric stapler of this invention, a sheaf of papers to be stapled is inserted edgewise into the slit at the front of the stapler and the motor is switched on, whereby the damper is operated to release the hold on the pressure receiving portion of the working arm, causing said arm to be forcedly turned downwardly about its shaft by the restoring force of the spring, this in turn causing the vertically movable block secured to an end of said arm to rapidly descend vertically along the guide cylinder. As a result, the staple at the head of a strip of staples loaded in a staple case is driven downwardly by the staple driver blade secured to the lower end of said block and driven through said sheaf of papers, and the legs of said staple extending out from the underside of the sheaf are bent inwardly along the staple bending groove to thereby bind said sheaf of papers.

As the motor is kept running, the damper is again operated to push up the pressure receiving portion of said working arm against the force of springs whereby said arm is now forced to swing upwardly about its shaft against the spring, just contrariwise to said case of stapling operation, causing the vertically movable block and its blade to ascend vertically along the guide cylinder. Said blade is thus raised up to its original position (before the staple driving operation is started) and stays ready for the next run of stapling operation.

Other objects and advantages of this invention will become clear as the invention is further described below with reference to the accompanying drawings.

DESCRIPTION OF THE PREFERRED EMBODIMENT

Figure 1:
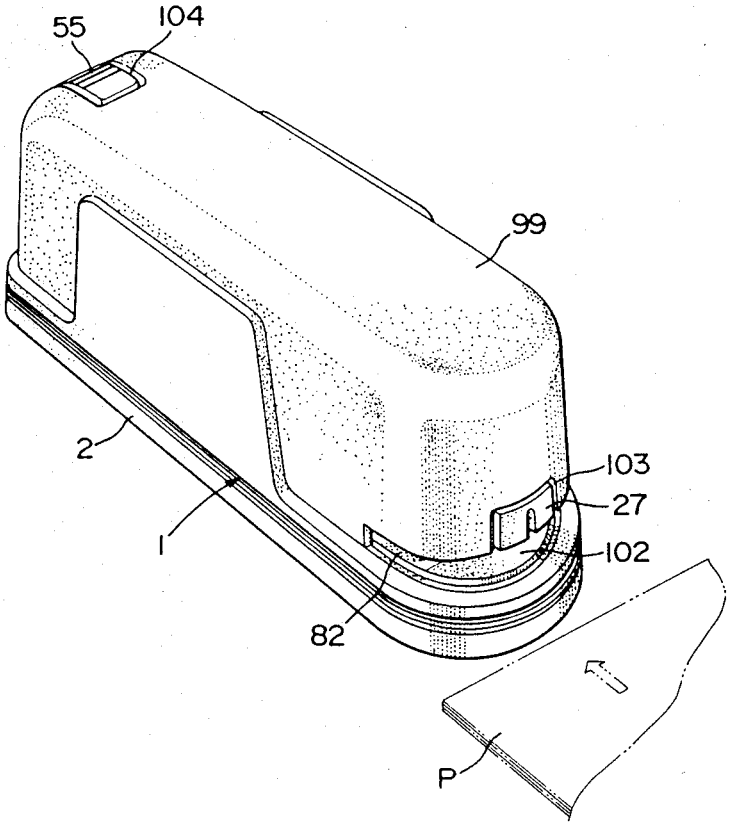
FIG. 1 is a general perspective view of an electric stapler according to this invention.
Figure 2:
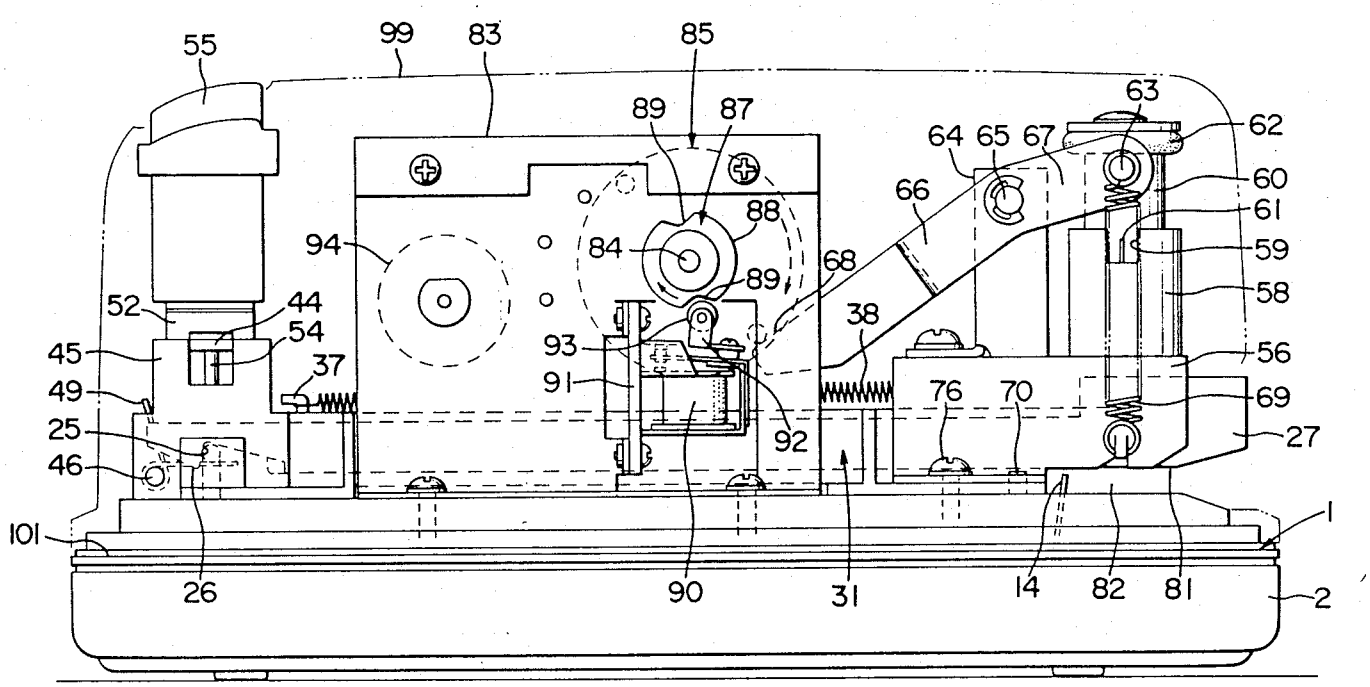
FIG. 2 is a side view thereof with the body cover removed.
Figure 3:
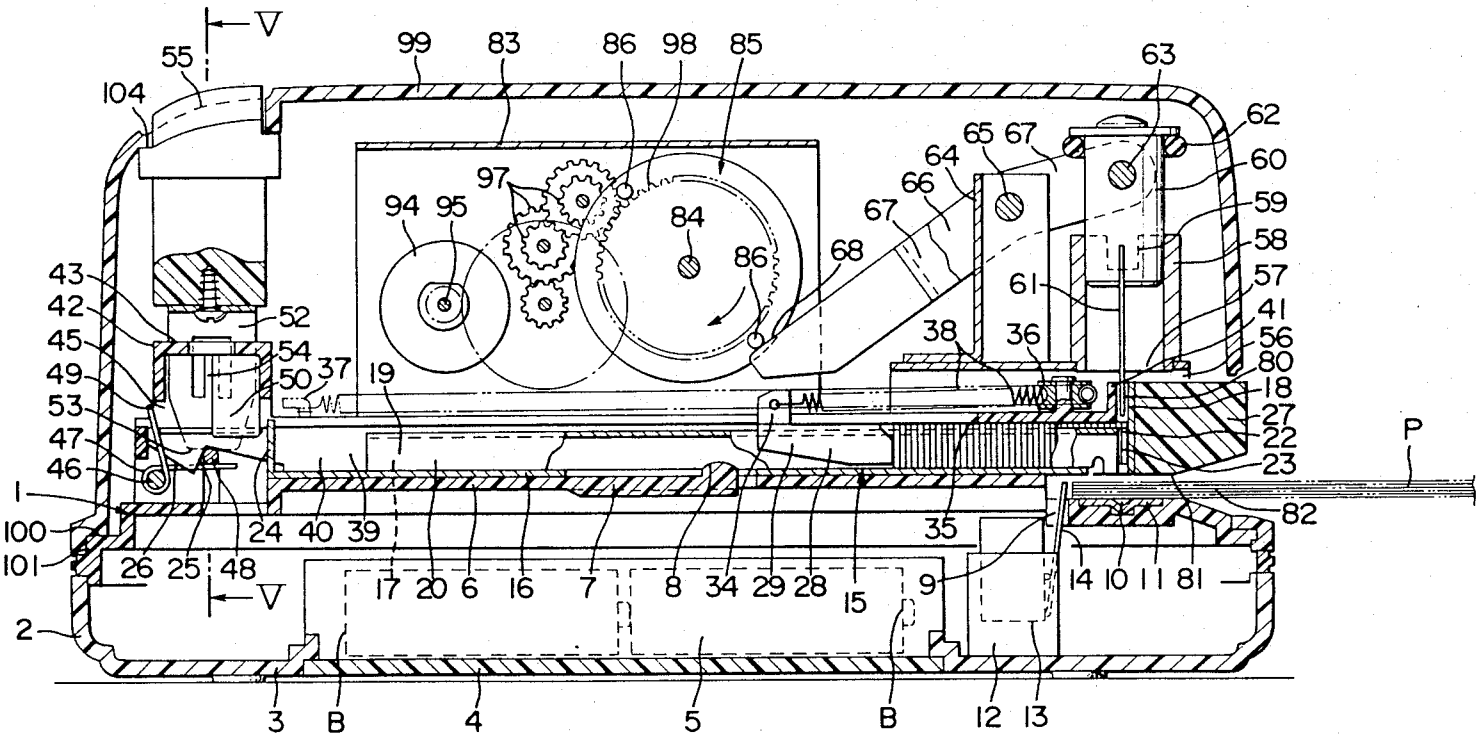
FIG. 3 is a central sectional view of the stapler shown in FIG. 1.
Figure 4:
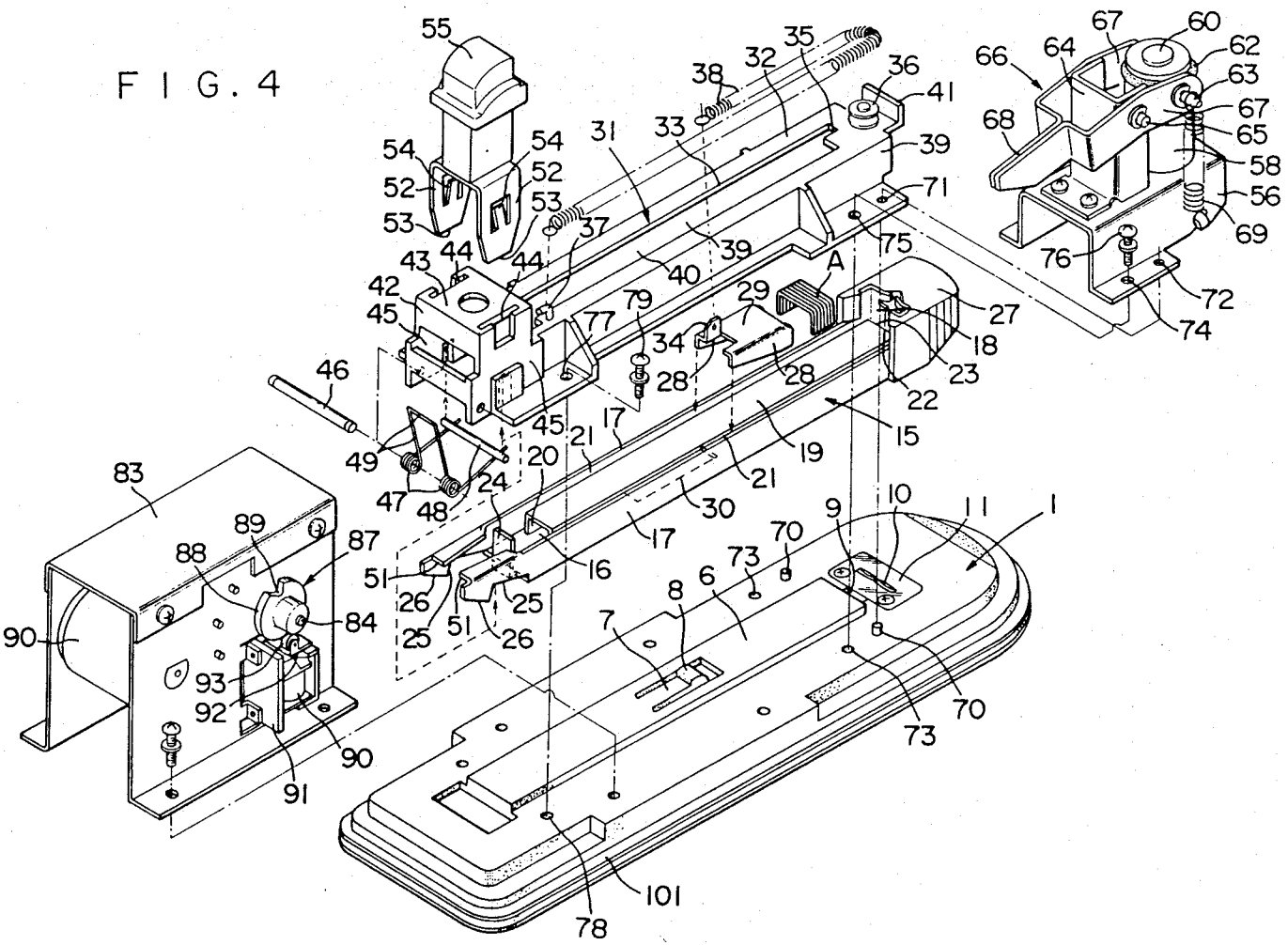
FIG. 4 is an exploded perspective view of said stapler.
Figure 6:
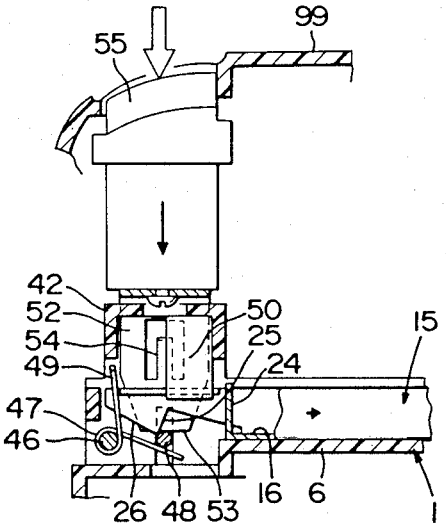
FIGS. 6 and 7 are the drawings illustrating the operation of a staple case locking mechanism in said stapler.
Figure 5:
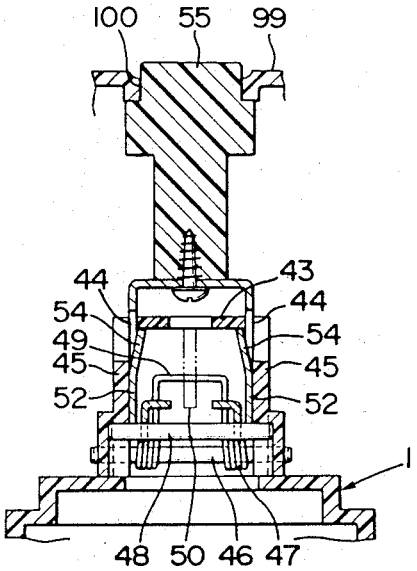
FIG. 5 is a sectional view taken along the line V—V of FIG. 3.
Figure 7:
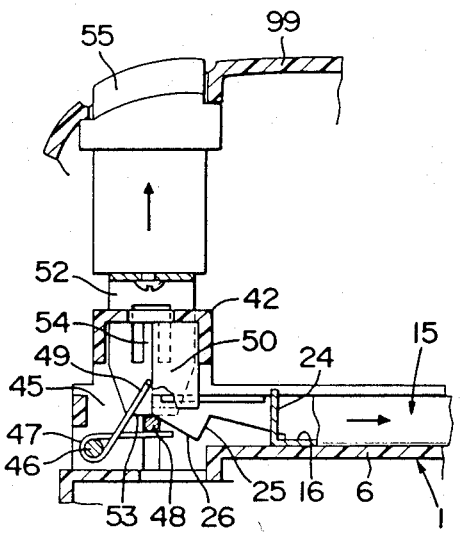

In the drawings, reference numeral 1 designates a base formed like s strip of plate. On the underside of said base 1 is detachably fitted a base cover 2 made of a synthetic resin. To the bottom plate 3 of said base cover 2 is detachably secured a cover plate 4. In said base cover 2 is provided a battery case 5 housing a battery B, which case can be opened and closed by said cover plate 4. A substantially central part of said base 1 rises up to form a longitudinally elongated guide plate 6. At the substantially central part of said guide plate 6 is formed a protuberance 7 which is elastically deformable in the vertical direction about a fixed end thereof. A round check 8 is formed at the free end of said protuberance 7 so that said check piece 8 bulges out from the upper surface of the guide plate 6. In the base 1, at an end of said guide plate 6 in its longitudinal direction, is formed an opening 9 leading into the inside of said base cover 2. On the outside of said opening 9 is provided an anvil 11 having a staple bending groove 10, said anvil being integrally embedded in the base 1. A switch 13 is fixed through a mounting frame 12 on the bottom plate 3 at an end of the battery case 5 in said base cover 2, and a normally closed contact switch lever 14 movably projects through and above said opening 9.

A staple magazine 15 is disposed movably forward and backward on the guide plate 6 of said base 1. Said magazine 15 has a slidable bottom plate 16 engaging movably with said guide plate 6 and a pair of opposing erect side plates 17 along both edges of said bottom plate 16. One end of each of said opposing side plates 17 terminates into a vertical staple guide plate 18 which is bent from said end of each side plate so as to position across the ends of said opposing side plates 17. On said slidable bottom plate 16 is fixedly disposed a U-sectioned staple guide frame 19 in its longitudinal direction. Between the respective opposing walls 20 of said staple guide frame 19 and the corresponding side plates 17 are formed the staple guide channels 21 in which the legs of a bar of staples A are movably fitted. Also, between one end 22 of said staple guide frame 19 and said staple guide plate 18 is formed a vertical opening 23 designed for guiding out one staple to said staple bending groove 10. A stopper 24 is erected from the end of the bottom plate 16 rearward of the other end (opposite from the end 22) of said staple guide frame 19. At a lower part toward the other end of each of said opposing side plates 17 is formed a recession 25, and a bevel is formed at the end part contiguous to said recession 25 to provide a slant guide edge 26. Further, at one end of said staple magazine 15 is secured a grip 27 made of a synthetic resin. On said staple guide frame 19 is movably mounted a slider 29 having its sliding portions 28 fitted in said opposing guide channels 21. Substantially at the center of the slidable bottom plate 16 of said staple magazine 15 is formed an opening 30 in which said protuberance 7 is placed when the parts are set in position.

Numeral 31 indicates a housing in which said staple case is movably housed. Said housing 31 is substantially inverted U-shaped in section and consists of opposing side plates 39 and a top plate 32, with the bottom thereof being open. In the inside of said magazine is formed a chamber 40 for housing said staple magazine 15. In the top plate 32 of said housing 31 is formed a longitudinally elongated guide slot 33, and at an end of said slot 33 is formed a recess 35 designed to receive a protuberance 34 provided on said slider 29. A guide roller 36 is pivotally supported on the top plate 32 near said recess 35, said roller 36 being engaged with a middle part of a coil spring 38 one end of which is secured to said protuberance 34 while the other end is fixed to a pin 37 provided on a part of said top plate 32 close to its other end. The slider 29 is normally forced by said coil spring 38 to push the bar of staples A into the guide channels 21. At the end of the top plate 32 positioned just outside of said guide roller 36 is provided a guide protuberance 41 which is positioned in opposition to said staple guide plate 18 when the parts are properly set in place. Further, a mounting frame 42 is provided at the other ends of said opposing side plates 39 of said magazine 31, and a pair of guide slots 44 are formed at both ends of the top plate 43 of said mounting frame 42. A shaft 46 is passed across the lower rear ends of the opposing side plates 45 of said frame 42, and a coil spring 47 is loaded on said shaft 46. At one free end of said spring 47 is integrally secured a lock bar 48 (which is engageable with said opposing recessions 25 and slant guide edges 26 of said staple magazine 15) while the other free end 49 of said spring 47 is disengageably engaged with a stopper 50 projecting downwardly from the underside of said top plate 43 of said frame 42. Arrangement is also made such that when said lock bar 48 is engaged in said recessions 25 of said staple magazine 15, said other free end 49 of said coil spring 47 will be compressedly engaged with the protuberances 51 formed at the other end of said staple magazine 15 so as to give a pressing force to said staple magazine 15. In said guide slots 44 at both ends of said mounting frame 42 are vertically movably inserted the unlocking plates 52 which push said lock bar 48. On the lower end portions of the unlocking plates 52 are formed push-out portions 53 for pushing out the lock bar 48. A substantially central part of each of said unlocking plates 52 is cut an bent inwardly to form a protuberance 54 which fits in the opening at the lower edge of the corresponding one of said guide slots 44. A push-button 55 is provided atop said unlocking plates 52.

Numeral 56 refers to a substantially inverted U-shaped connecting frame. At a side part of the top plate of said frame 56 is formed an opening 57, and a cylindrical guide member 58 is erected from the edge of said opening 57. At the open top edge of said guide cylinder 58 are formed recessions 59 in opposed relation to each other. A columnar block 60 is vertically movably fitted in said guide cylinder 58, and at the lower end of said block 60 is secured a downwardly projecting blade 61 for driving a bar of staple A toward the staple bending groove 10 on the anvil 11. At the upper end of said columnar block 60 are provided an elastic ring 62 engaged with the top end of said guide cylinder 58 (when said block is lowered down) and a cross bar 63 arranged such that its both ends are disengageably fitted in said recessions 59 at top edge of said guide cylinder 58. Toward the other side of the top plate of said connecting frame 56 is erected a support frame 64, and a working arm 66 is swingably secured thereto. Said working arm 66 is bifurcated at one end thereof into two opposing connecting members 67 which are pivotally secured to the upper parts of said support frame 64 through a shaft 65, the other end of said working arm 66 being designed to serve as a pressure receiving portion 68. Both ends of said cross bar 63 of said vertically movable block 60 are secured to the upper ends of coil springs 69 whose lower ends are secured to said connecting frame 56 so that said block 60 is always pressed downwardly by said coil spring 69.

Said staple magazine 15 is disposed on the guide plate 6 of said base 1, and said housing 31 is further mounted on said base 1 so as to cover said staple magazine 15. Said connecting frame 56 is disposed covering one end of said housing 31. A pair of pins 70 projecting from the surface of said base 1 (on both sides thereof toward one end) are passed through the corresponding holes 71 in said housing 31 and further through the corresponding holes 72 in said connecting frame 56 to thereby set the magazine 31 in position. Also, screws 76 are passed through the corresponding holes 74 in said connecting frame 56 and through the holes 75 in said housing and threadedly engaged into the corresponging tap holes 73 in said base 1. Further, screws 79 are passed through the corresponding holes 77 at the other end of said housing 31 and threadedly driven into the corresponding tap holes 78 at the other end of said base 1.

By this means, the staple driver blade 61 of said vertically movable block 60 can move into or out of the staple guide-out opening 23 through a guide space 80 formed thereabove between said staple guide plate 18 and said erect protuberance 41. Also, said staple magazine 15 is housed in the chamber 40 in said housing 31 so as to be movable forward and backward along the guide plate 6. When said staple magazine 15 is pushed into its innermost position, the lock bar 48 is engaged in the recessions 25 at the end of said staple case 15 and also the free end 49 of the spring 47 is pressed against the protuberances 51 of said magazine 15, thus forming the staple guide-out opening 23 between one end 22 of said guide frame 19 and said guide plate 18 while also forming a paper inserting slit 82 between the underside portion 81 of the grip 27 and the anvil 11 embedded in the base 1.

Numeral 83 designates a substantially inverted U-shaped housing frame disposed on the substantially middle part of said base 1, that is, positioned between said connecting frame 56 and said push-button 55. A shaft 84 is passed horizontally across both sides of said frame 83 toward one end thereof, and a rotary disc 85 adapted to serve as a damper is fixedly mounted on said shaft 84. On one side of said rotary disc 85 and close to the edge thereof are provided a plural number of pins 86 arranged to intermittently abut against and push downward the pressure receiving portion 68 of said working arm 66. Also, a cam disc 87 is secured to an end of said shaft 84, said cam disc 87 having recesses 89 formed in opposed relation to each other on the periphery 88 thereof. A base plate 91 of a relay switch 90 is secured to a part of said frame 83 positioned just below said cam disc 87, and a roller 93 is pivotally supported above an actuator 92 of said relay switch 90. Said roller 93 is so arranged that it is forced to move through engagement with the periphery 88 of said cam disc 87 and released from its moving force when it falls in a recess 89. A motor 94 is provided in a section at the other end of said frame 83. On the output shaft 95 of said motor 94 is fixedly mounted a pinion 96 which is engaged through a train of gearings 97 with a drive gear 98 provided integral with said rotary disc 85.

Numeral 99 denotes the synthetic resin-made body cover designed to cover said magazine 31 and connecting frame 56. A stepped portion 100 formed on the inside of the open bottom edge of said body cover 99 is tightly fitted on a corresponding stepped portion 101 of the base 1. At the lower front portion of said body cover 99 is formed a half-circular paper guide opening 102 in communication with said paper inserting slit 82, and also an opening 103 through which said grip 27 can be attached and detached is formed in communication with said paper guide opening 102. At the top rear end of said body cover 99 is also formed an opening 104 for accommodating said push-button 55.

Figure 9:
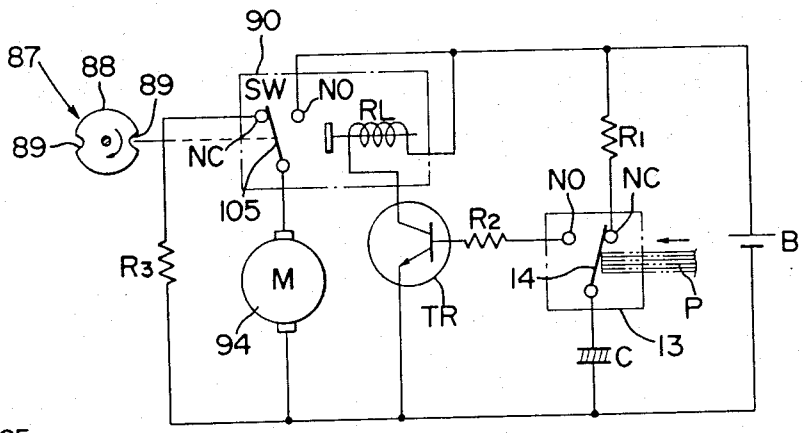
FIG. 9 is a circuit diagram.
Figure 8:
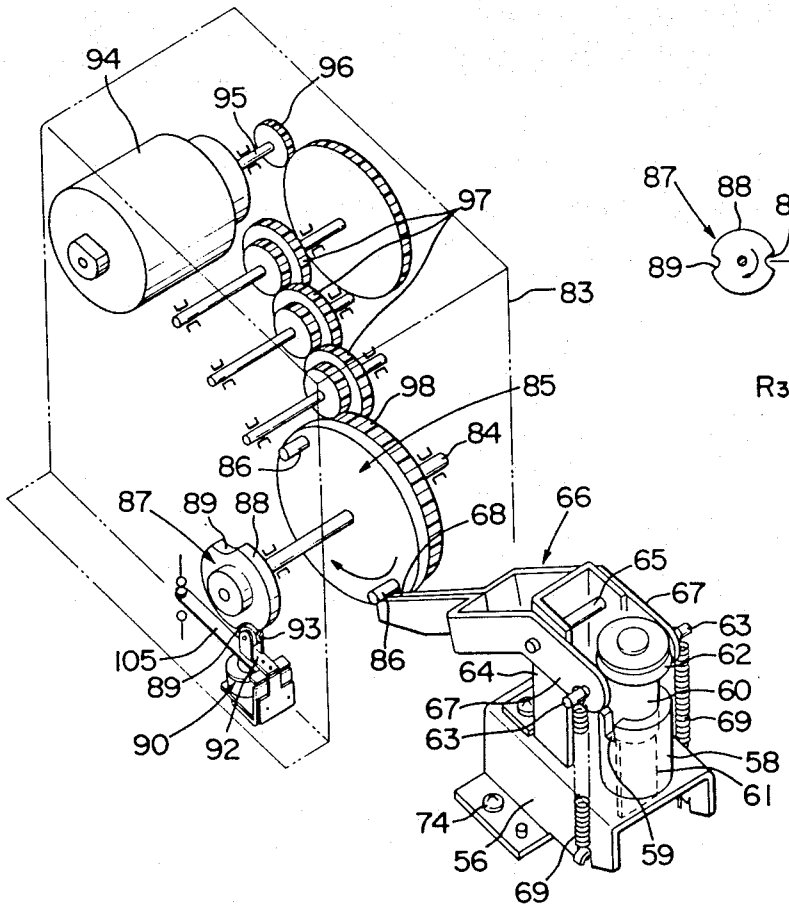
FIG. 8 is a perspective view of a staple driver blade controlling mechanism.

Now, the electric circuitry of the present device is explained with reference to FIG. 9. A resistor R1, said switch 13 and a capacitor C are connected in series between both terminals of said battery B, and a resistor R2 is connected to the normally open contact NO of said switch 13 through the base of a transistor TR. Also, the emitter of said transistor TR is connected to one terminal of said battery B while the collector of said transistor TR is connected to the other terminal of said battery B via a relay RL of said relay switch 90. Further, the switch SW of said relay switch 90 is connected to the other terminal of said battery B via said motor 94 while the normally closed contact NC of said switch SW is connected to one terminal of said battery B via a resistor R3.

In the non-operative state of the device, the electric current from the battery B runs to the capacitor C through resistor R1 and switch lever 14 connected to the normally closed contact NC to charge said capacitor C, but when the roller 93 in the actuator 92 of said relay switch 90 is positioned in a recess 98 of said cam disc 87, the switch lever 105 of the switch SW which is operatively connected to said actuator 92 is connected to the normally closed contact NC of said switch SW to disenergize the relay RL. Also, a pin 86 on the rotary disc 85 provided coaxially with said cam disc 87 presses downward the pressure receiving portion 68 of the working arm 66 against the force of springs 69 on both sides of said arm to raise up the staple driver blade 61 secured to the vertically movable block 60 to a position above the strip of staples A so that said blade 61 stays ready for driving the leading one of said strip of staples A.

The operation of the above-described mechanism of the present device will now be explained.

When a sheaf of papers to be stapled is inserted edgewise into the paper inserting slit 82 from the guide opening 102 of the body cover 99 and the inserted end of said sheaf of papers P presses the switch lever 14 of the switch 13, said switch lever 14 is separated from the normally closed contact NC and connected to the normally open contact NO to turn on the switch 13, whereupon a voltage is generated in the base of the transistor TR by the charged electricity of the capacitor C through the resistance R2, and the transistor TR becomes conductive only by the time constant voltage of said capacitor C and resistor R2 to form a one-shot circuit. As this transistor TR is actuated, the relay RL of the relay switch 90 connected to the collector side is energized to draw the switch lever 105 of the switch SW. Accordingly, said switch lever is separated from the normally closed contact NC and connected to the normally open contact NO to turn on the switch SW. As this switch SW is turned on, the electric current from the battery B is applied to the motor 94 to let it operate. The current supply to the relay RL is ended in a short time by the one-shot circuit and the relay RL shows the tendency to restore its original state, but in this case, since the motor 94 is in operation, its driving force is transmitted through the pinion 96 of said motor 94, a train of gearings 97 and drive gear 98 to the rotary disc 85 to let it rotate, and accordingly the pin 86 of said disc 85 is disengaged from the pressure receiving portion 68 of the working arm 66 to release the pressing force on said arm 66, whereupon said arm 66 is forced to turn about the shaft 65 by the restorative force of the springs 69 on both sides of said arm, and this forces the vertically movable block 60 secured between the connecting members 67 of said arm 66 to descent along the guide cylinder 58. With this descending movement of said block 60, the staple driver blade 61 provided integral with said block is forced to descend rapidly along the guide space 80, and the forefront staple of a strip of staples A driven into the opening 23 by the slider 29 is separated from said strip and driven downwardly by the lower end of said blade 61. As said blade 61 is further lowered down through said space 80 into said guide-out opening 23, both legs of the driven staple are driven through the sheaf of papers P and bent inwardly at the backside of said sheaf by the staple bending groove 10 on the anvil 11 to staple together said sheaf of papers P, and at this point both ends of the cross bar 63 of said block 60 are placed into the recesses 59 of the guide cylinder 58.

Synchronously with said operation, the rotary disc 85 is rotated as described above, causing the corresponding rotation of the cam disc 87 provided integral with said rotary disc 85, and the periphery 88 of said cam disc 87 continues to press the actuator 92 of the relay RL of the relay switch 90 through the roller 93 provided to said actuator 92, so that the switch lever 105 of the switch SW is kept connected to the normally open contact NO to maintain the switch SW on, keeping the motor 94 in operative mode.

As the rotary disc 85 is further turned by the driving force of motor 94 through its pinion 96, train of gearings 97 and drive gear 98 and the next pin 86 on said disc 85 is again engaged with the pressure portion of the working arm 66, said arm 66 is turned about the shaft 65 against the force of springs 69 on both sides of said arm and the vertically movable block 60 is accordingly raised upwards of the guide cylinder 58, so that the staple driver blade 61 secured to said block 60 is also raised up from the drive-out opening 23 into the guide space 80.

The turning movement of said rotary disc 85 also causes the corresponding turn of the cam disc 87 provided coaxially with said disc 85, and when the next recess 89 of said cam disc 87 moves to the position directly opposing to the roller 93 of the actuator 92 of the relay RL, said roller 93 is automatically engaged in said recess 89 and, by the operation of said actuator 92, the switch lever 105 is separated from the normaly open contact NO of the switch SW and again automatically connected to the normally closed contact NC to turn the switch SW off and form a circuit for shortcircuiting the motor 94 through resistance R3 to suddenly stop the motor 94.

Thus, almost synchronously with the rise-up of the staple driver blade 61 into the guide space 80 by the turn of the rotary disc 85, the roller 93 of the actuator 92 is engaged in the recess 89 by the turn of the cam disc 87 to stop the motor 94 and the paper binding operation is ended.

When the stapled sheaf of papers P is drawn out of the slit 82, the switch lever 14 of the switch 13 is again separated from the normally open contact NO and automatically connected to the normally closed contact NC, and thus the capacitor C is again charged in the manner described above to let the device stay ready for the next run of stapling operation.

The manner of loading a bar of staples A in the staple magazine 15 will be explained below.

When the push-button 55 exposed atop the body cover 99 is depressed, a pair of release bars 52 provided integral with said push-button 55 are also lowered down along the guide slots 44 of the mounting frame 42 and the push portions at the lower ends of said bars 52 push the lock bar 48 downward against the spring 47. The free end 49 of the spring 47 amasses force under the pressing force of said lock bar 48 and is strongly pressed against the protuberances 51 of the staple magazine 15 in the direction of pushing said staple case 15 forwardly.

When the lock bar 48 comes away downwardly from the recesses 25 of the staple magazine 15, the free end 49 of the spring 47 pushes the protuberances 51 of said staple magazine 15 under the force of the spring.

Accordingly, the lock bar 48 is turned back to its original position while pushing up the release bars 52 to bring the push-button 55 to its normal (raised-up) position to stay ready for the next operation. At the same time, the staple magazine 15 is pushed forward sliding on the guide plate 6 of the base 1 by the pressing force of the free end 49 of the spring 47, and the grip 27 at the end of said staple magazine 15 is forced out from the opening 103 of the body cover 99 while the free end 49 of the spring 47 is engaged with the stopper 50. Since the guide plate 6 is provided with a protuberance 7 having a bulged check portion 8 at its free end, the edge of the opening 30 formed in the sliding bottom plate 16 of said staple magazine 15 pushed forward by the spring action abuts against and is checked by said check portion 8, so that the staple magazine 15 is not excessively pushed out from the opening 103; it is pushed out only to such an extent that the grip 27 alone is exposed out.

When the user holds the grip 27 and pulls out the staple magazine 15, the edge of the opening 30 in the bottom plate 16 of said staple magazine 15 passes over the check portion 8 against its elastic resisting force, and thus the staple magazine 15 can be drawn out with its bottom plate 16 sliding over said check portion 8. Also, the projection 34 of the slider 29 provided in said staple magazine 15 moves along the guide slot 33 of the housing 31 until it is engaged in the recess 35 at the end of said guide slot 33, whereby the staple magazine 15 is locked against further drawing.

The staple case is then replenished with a strip of staples A which is placed between the slider 29 and the staple guide plate 18 through the staple guide frame 19, and the loaded staple magazine 15 is again pushed back. The staple magazine 15 can be smoothly pushed back to its normal position with the bottom plate 16 thereof sliding on the guide plate 6 against the elastic resisting force of the check portion 8 until said check portion 8 is positioned in the opening 30 of said bottom plate 16 of the staple magazine 15.

Then the lock bar 48 of the spring 47 is engaged with the slant guide edge 26, and as the staple magazine 15 is further pushed back, said lock bar 48 is gradually pushed downward by said guide edge 26 while the free end 49 of the spring 47 is pushed by the protuberances 51 of the staple magazine 15 and gradually accumulates force. When the recesses 25 of the staple magazine 15 come to the position of the lock bar 48, the latter is automatically engaged in said recesses 25, and the staple magazine 15 is locked by said lock bar 48 in a state of being pressed forwardly by the free end 49 of the spring 47.

In this way, the staple magazine 15 loaded with a strip of staples A is set in the housing 31 in a state of being housed in the chamber 40 in said housing. The strip of staples A in said staple magazine 15 is pushed out into the staple drive-out opening 23 by the slider 29 which is always forced toward said opening 23 by the coil spring 38, and each time the staple at the head of said strip of staples A is driven out, the second one is automatically forced out into said opening 23 to stay ready for the next stapling operation.

EFFECT OF THE INVENTION

According to the present invention, as a columnar block having at its lower end a downwardly projecting staple driver blade is provided vertically movably in a guide cylinder disposed above the staple bending groove on the base, it is possible to let said block and blade make up and down movements correctly and smoothly while maintaining a vertical position. Said vertically movable block is always pressed downwardly by a spring and is normally kept at its raised-up position against the spring, but when carrying out stapling, the holding force on said block is released, causing the staple driver blade secured thereto to be rapidly lowered down vertically by the restorative force of the spring. Since said blade projects out from the lower end of the block which is lowered down directly by a spring, said blade can positively push out a staple and let its legs be securely driven through a sheaf of papers under the combined force of the spring and the own weight of said block to perform the paper binding operation instantaneously. Further, since the up and down movement of said block is controlled by the operation of a damper which is controlledly driven by a motor through springs and a working arm, the staple driver blade of said block can be securely held at its raised-up position in preparation for the insertion of a sheaf of papers to be stapled. Also, such holding can be positively released when a staple is to be driven. Moreover, since a battery is used as power source of the motor, the stapler can be used at a place where no commercial power source is available, and since no cord is necessary, there is not need of handling a cord and the device is easy to operate and has good appearance. Still further, the mechanism for effecting the up and down movement of the staple driver blade is simple and also the number of parts of the device is small, allowing a reduction of manufacturing cost. It is thus possible to provide an electric stapler which is small in size and handy to carry.

What is claimed is:

1. An electric stapler comprising a base having a groove for bending a driven staple, a guide cylinder fixedly disposed above said staple bending groove of said base in a way to form a slit for inserting a sheaf of papers to be stapled, a movable block provided vertically movably in said guide cylinder, said block having at its lower end a downwardly projecting driver blade for driving a staple toward said staple bending groove, springs arranged to always press said block downwardly, a working arm swingably supported by a shaft disposed spaced-apart from said guide cylinder, one end of said arm being pivotally secured to an upper part of said block and the other end forming a pressure receiving portion, and a damper operated by a motor powered by a battery, said damper being designed to push the pressure receiving portion of said arm against said spring to keep the staple driver blade of said block at its raised-up position before the staple driving operation and release said hold on said blade when a staple is driven.

2. The electric stapler according to claim 1, wherein said guide cylinder is fixedly disposed in alignment with the staple bending groove on an inverted U-shaped connecting support frame secured to a side of the base, and the shaft swingably supporting the substantially middle part of the working arm is provided at an upper part of a support frame erected on said connecting frame.

3. The electric stapler according to claim 1, wherein the springs arranged to always press said vertically movable block downwardly are disposed on both sides of said block, said springs being secured at one end to the upper parts on both sides of said block and fixed at the other ends to the connecting frame.

4. The electric stapler according to claim 1, wherein said damper has pins arranged to engage with and push the pressure receiving portion of said working arm intermittently and is connected to the motor through a train of gear.

5. The electric stapler according to claim 1, wherein said damper is provided with a cam disc designed to turn on or off a switch SW of the motor by which said damper is operated.

* * * * *